US006308017B1

(12) United States Patent
Taniyama et al.

(10) Patent No.: US 6,308,017 B1
(45) Date of Patent: Oct. 23, 2001

(54) IMAGE FORMING SYSTEM INCLUDING OSCILLATING TYPE WASTE TONER CONTAINER

(75) Inventors: Yoshiharu Taniyama, Kawasaki; Noriyuki Umezawa; Shinichi Itoh, both of Yokohama, all of (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/506,371

(22) Filed: Feb. 18, 2000

(51) Int. Cl.[7] ..... G03G 21/10
(52) U.S. Cl. ..... 399/35; 399/358
(58) Field of Search ..... 399/12, 34, 35, 399/358, 360

(56) References Cited

U.S. PATENT DOCUMENTS 4,436,414 * 3/1984 Kamiyama et al. ..... 399/35
5,534,988 * 7/1996 Gerbasi ..... 399/358

FOREIGN PATENT DOCUMENTS 11-327272 11/1999 (JP) .

* cited by examiner

*Primary Examiner*—William J. Royer
(74) *Attorney, Agent, or Firm*—Foley & Lardner

(57) ABSTRACT

An image forming system has: a developing device for causing a toner to adhere to a latent image, which is formed on a photosensitive material drum, to form a visible image; a toner supply device for supplying a toner, which is housed in a toner container, to the developing device; a toner removing device for removing a remaining toner after the visible image on the photosensitive material drum is transferred to a transfer paper; a waste toner container for accumulating therein a waste toner removed by the toner removing device; and an oscillating mechanism for oscillating the waste toner container. Thus, the waste toner in the waste toner container can be efficiently accumulated, so that the system can be miniaturized.

12 Claims, 7 Drawing Sheets

IMAGE FORMING SYSTEM INCLUDING OSCILLATING TYPE WASTE TONER CONTAINER

BACKGROUND OF THE INVENTION

1. Field of The Invention

The present invention relates generally to an information forming system having a toner recovering function of recovering a toner remaining on a surface of a photosensitive material drum after transferring an image to a paper, a waste toner container for accumulating a recovered waste toner, and a toner container used in connection with the recovery of the toner.

2. Description of the Related Background Art

In image forming systems, such as copying machines, facsimiles and printers, a photosensitive material drum is electrified to be exposed in accordance with an image, and a toner is absorbed onto the photosensitive material drum to carry out developing for forming a visible image. After this visible image is transferred to a transfer paper, fixing is carried out by heating, so that a desired copy is obtained.

After the transfer to the transfer paper, excessive toner remains on the photosensitive material drum. Since such a toner remaining on the photosensitive material drum has an adverse influence on the next copying, the remaining toner must be completely removed.

In order to remove such a remaining toner after fixing, a cleaner is conventionally provided. This cleaner has a de-electrifier for de-electrifying the photosensitive material drum before cleaning, and a blade for raking down the toner on the photosensitive material drum. The toner removed by the de-electrifier and the blade is housed in a container called a waste toner box. These are known generally as a toner recovery unit.

A conventional waste toner box must have a sufficient size since a waste toner introduced into the toner box via an inlet naturally drops to accumulate therein.

Describing this point in detail, FIG. 5 shows the state that waste toner accumulates in a waste toner box. This waste toner box 20 has a laterally elongated flat box shape. Only a right end portion 20*a* of the waste toner box 20 rises so as to approach the above described cleaner portion. An opening 20*b* is formed in the top of the right end portion 20*a*. The toner raked down by the blade of the cleaner is introduced into the opening 20*b* by means of a suitable guiding portion (not shown) to be housed in the waste toner box 20.

As described above, since the accumulation of the waste toner is carried out by the natural drop via the opening 20*b*, the waste toner is sequentially accumulating in the waste toner box, so that the accumulation has a substantially conical shape as shown by a curved solid line a.

Therefore, if the top end of the accumulation approaches the opening 20*b* as shown in FIG. 5, the waste toner can not further accumulate although a space for accumulation remains as a whole.

To solve this problem, conventionally, a sensor comprising a light emitting element 22 and a light receiving element 23 is provided for monitoring the filling state of the toner. If it is detected by the sensor that the height of the accumulation of the waste toner exceeds a predetermined height, an alarm is produced to allow the operator to shake the waste toner box 20 or the like to flatten the top of the waste toner as shown by a curved line b, or to continue a copying operation after the waste toner box is exchanged.

In addition, conventionally, it is supposed that the waste toner box is not frequently exchanged, and the waste toner box must have a large capacity since the above described accumulation of the toner is carried out. This deteriorates the degree of freedom of design, or prevents the miniaturization of the system.

On the other hand, toners supplied to image forming systems have been improved as important components for enhancing the quality of an image, and manufacturers have provided the optimum toners for the design specification of their systems as genuine products (which will be hereinafter referred to as "certified products").

In recent years, toners meeting the minimum specifications common to image forming systems commercially available from a plurality of manufacturers are in circulation. There is a problem in that such toners meeting only a part of specifications (which will be hereinafter referred to as "uncertified toners") generally have inferior image quality and have a bad influence on a photosensitive material drum serving as an image carrier and a developing part, to adversely effect the reliability of the systems.

A typical toner is generally housed in a container to be provided. Conventionally, although toners have been sometimes improved to be easily handled, toners have not often been improved to recommend the certified products.

In particular, although the above described waste toner box is closely related with a toner cartridge, the waste toner box and the toner cartridge are separately attached or exchanged, and there is a problem in that the waste toner box can be used whether the toner cartridge is a certified product or an uncertified product.

SUMMARY OF THE INVENTION

It is therefore an object of the present invention to provide an image forming system which uses a waste toner container capable of being miniaturized and which has a toner recovery function.

It is another object of the present invention to provide a waste toner container which urges a user to use a certified toner container.

According to the first aspect of the invention, there is provided an image forming system comprising:

- a developing device for causing a toner to adhere to a latent image, which is formed on a photosensitive material drum, to form a visible image;
- a toner supply device for supplying a toner, which is housed in a toner container, to said developing device;
- a toner removing device for removing a remaining toner after said visible image on said photosensitive material drum is transferred to a transfer paper;
- a waste toner container for accumulating therein a waste toner removed by said toner removing device; and
- an oscillating mechanism for oscillating said waste toner container.

In this image forming system, the size of the waste toner container can be decreased, so that the whole system can be miniaturized.

According to the second aspect of the present invention, there is provided a waste toner container for use in an image forming system comprising: a developing device for causing a toner to adhere to a latent image, which is formed on a photosensitive material drum, to form a visible image; a toner supply device for supplying a toner, which is housed in a toner container, to said developing device; and a toner removing device for removing a remaining toner after said visible image on said photosensitive material drum is transferred to a transfer paper, said waste toner container accumulating therein a waste toner removed by said toner removing device, and said waste toner container having an oscillating mechanism for oscillating said waste toner container to break the accumulation of a waste toner therein.

Such a waste toner container urges the user to use it integrally with a toner container, so that it is possible to enhance the ratio of the use of a certified product.

According to the third aspect of the present invention, there is provided a toner container for use in an image forming system comprising: a developing device for causing a toner to adhere to a latent image, which is formed on a photosensitive material drum, to form a visible image; a toner supply device for supplying the toner to said developing device; a toner removing device for removing a remaining toner after said visible image on said photosensitive material drum is transferred to a transfer paper; and a waste toner container for accumulating therein a waste toner removed by said toner removing device, said waste toner container being oscillatable and biased so as to return to an initial position, said toner container housing therein the toner supplied to said toner supply device, said toner container having a protruding portion which is engageable with a protruding portion provided on said waste toner container when said toner container is attached at a predetermined position, and said toner container rotating to slide said waste toner container.

Since such a toner container must be used integrally with the waste toner container, so that it is possible to enhance the ratio of the use of a certified product.

DESCRIPTION OF THE PREFERRED EMBODIMENTS

Referring now to the accompanying drawings, the preferred embodiments of the present invention will be described below.

Figure 1:
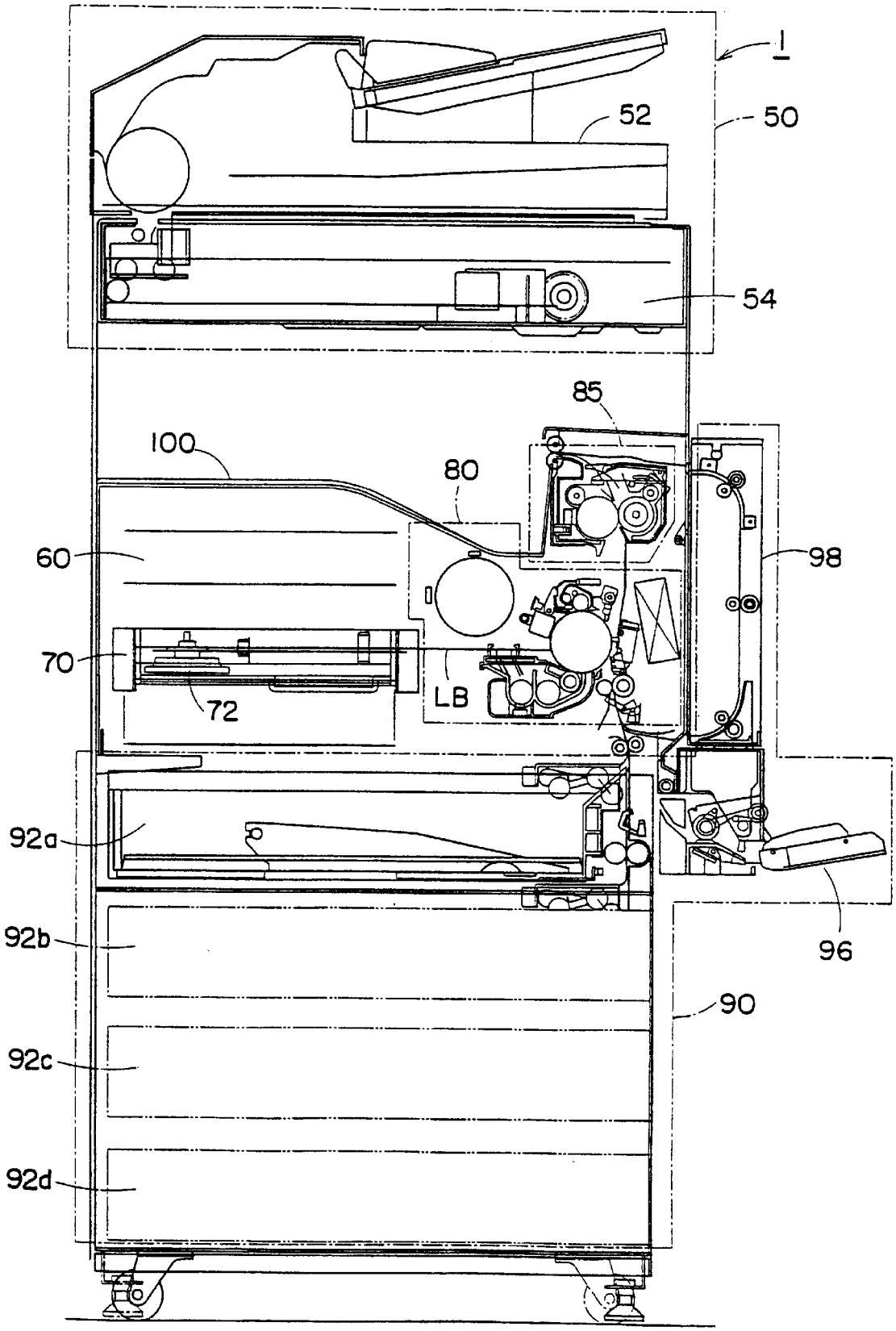
FIG. 1 is a schematic diagram showing an example of a copying machine serving as an image forming system according to the present invention.

FIG. 1 is a front perspective view schematically showing the construction of an example of an image forming system, to which a toner recovery device according to the present invention is applied.

A copying machine shown in FIG. 1 is a plain paper copier of a digital system for once converting image information, which is acquired by optical means, into image data to produce laser beams on the basis of the image data to scan a photosensitive material drum.

As shown in FIG. 1, the copying machine 1 comprises an image reading part 50 provided in the upper portion of the machine body thereof, an image storing part 60 provided in the middle portion of the machine body, a laser unit 70, an image forming part 80, a fixing part 85 and a paper feeding part 90.

The paper feeding part 90 includes a plurality of stages of paper feeding units 92*a* through 92*d*, a manual paper feeding tray 96 and a double face unit 98. The paper feeding units 92*a* through 92*d* are provided in the bottom portion of the machine body, and house therein a large number of sheets, on which images are transferred. Although plain papers are usually used as the sheets, tracing papers and OHP films may be used. The manual paper feeding tray 96 is provided in the vicinity of the image forming part 80 on the right side of the machine body, so that sheets having sizes other than the Japanese Industrial Standard sizes, and thick papers 15 such as postal cards can be manually fed. The double face unit 98 is provided on the right side in the middle portion of the machine body, and turns a sheet, which has once passed through the image forming part 80 and to one face of which an image has been transferred, over to feed the sheet to the image forming part 80 again to copy images on both sides of the sheet.

The image reading part 50 includes a scanner 54 and an automatic document feeding unit 52. The scanner 54 reads the image of a manuscript and converts the image into image data. The automatic document feeding unit 52 feeds a sheet manuscript into the scanner 54.

The image storing part 60 stores therein image data supplied from the scanner 54. The laser unit 70 has a plurality of semiconductor laser oscillators (not shown) and a polygon mirror 72. The image data are taken out from the image storing part 60, and the semiconductor laser oscillators are caused to emit laser beams LB, which are reflected on the polygon mirror 72 to scan on the image forming part 80.

Figure 2:
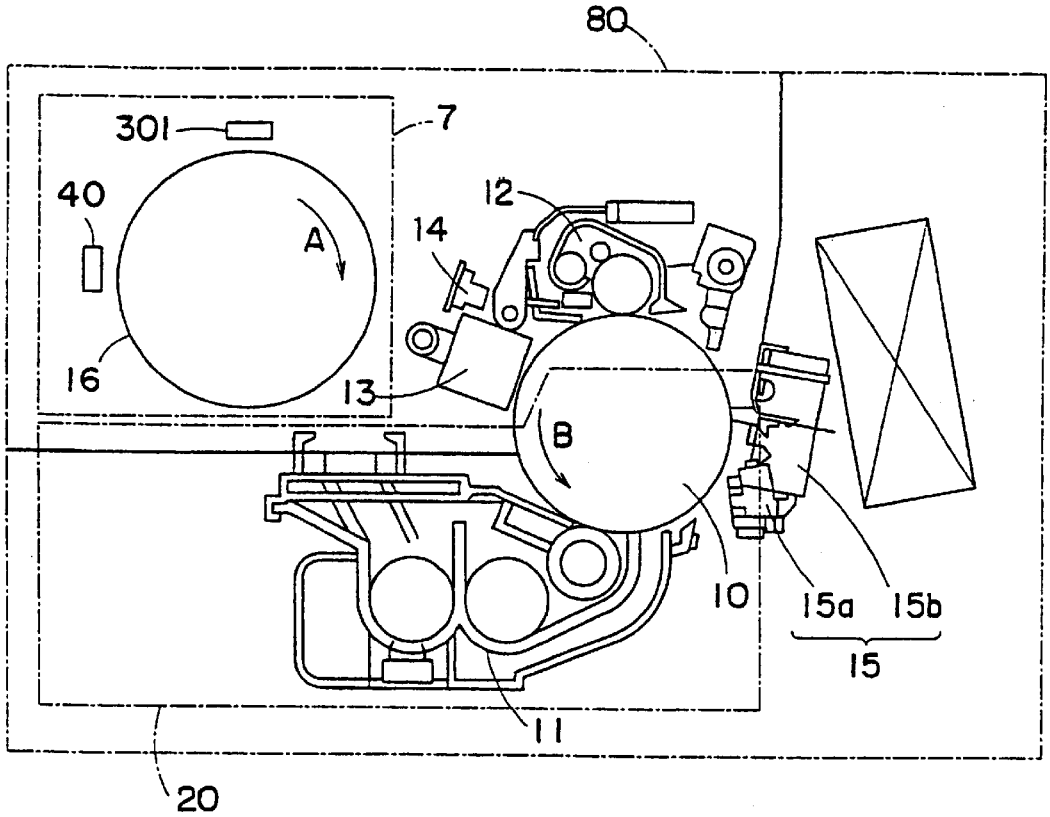
FIG. 2 is an enlarged view of an image forming part of the copying machine of FIG. 1.

FIG. 2 is an enlarged front view showing a principal part of the image forming part 80.

In the following description, the same reference numerals are given to elements which are the same as those in FIG. 1 and their detailed descriptions will be omitted.

As shown in this figure, the image forming part 80 comprises a photosensitive material drum 10, an electrification charger 13, a developing device 11, a transfer/peeling charger 15, a drum cleaner 12, a de-electrifying lamp 14, and a toner supply device 7 in this preferred embodiment.

During a developing operation, the photosensitive material drum 10 rotates counterclockwise B.

The image forming part 80 shown in FIG. 2 adopts a reverse developing system. In the image forming part 80, when the electrification charger 13 electrifies electric charges of a negative polarity on the photosensitive material drum 10 and when the photosensitive material drum 10 is exposed to the laser beams LB emitted from the laser unit 70, the surface potential of the photosensitive material drum 10 in a region corresponding to the image portion of the manuscript approaches zero in accordance with the density of the image to form a latent image.

The copying machine 1 adopts a two-component system. The developing device 11 houses therein a carrier and a toner. The toner is supplied to the developing device 11 so as to have a percentage of about 5% to the carrier of about 95%. The amount of the toner is always monitored by a magnetic sensor (not shown) or the like. If the percentage of the toner in the developing device 11 falls below 5%, a toner supply part 18, which will be described later, of the toner supply device operates to supply a required amount of toner to the developing device 11. The carrier and the toner are agitated in the developing device 11, so that electric charges of a negative polarity are applied to the toner by the frictional electrification during agitation. When the latent image arrives above the developing device 11 by the rotation of the photosensitive material drum 10, the toner is absorbed onto the photosensitive material drum 10 via the carrier to form a visible image. The visible image is carried from the paper feeding part 90 to be transferred to a sheet which is previously electrified to a positive polarity by a transfer charger 15*a*. Immediately after the transfer, positive charges are removed from the sheet by a peeling charger 15*b*, to which the image has been transferred, and then, the sheet is carried to the fixing part 85. The fixing part 85 causes the toner to fuse and adhere to the sheet by thermo compression bonding, and carries the sheet to a paper discharging tray 100 (see FIG. 1).

The toner which has not been transferred to the sheet and which remains on the surface of the photosensitive material drum 10, together with paper powder adhering to the toner from the sheet, is removed by the drum cleaner 12. The remaining charges of the photosensitive material drum 10 are removed by the de-electrifying lamp 14.

A waste toner box 20 shown by an imaginary line for accumulating the toner removed by the drum cleaner is provided on the front side. This waste toner box 20 will be described later.

The toner supply device 7 comprises a substantially cylindrical toner cartridge 16, an optical sensor 40 for reading a discriminating label (not shown) including information relating to the toner cartridge specification and being adhered on the peripheral surface of the cylinder and a cleaning part 301 for cleaning the discrimination label prior to the reading. The discriminating label has information relating to the toner cartridge 16, for example, the fact that the toner cartridge 16 is a certified product, the type and destination (countries and regions on the market, and OEM provided manufacturers) of machines, on which the toner cartridge 16 is attached, the capacity of the container, the material and components of the toner, and color of the toner when the toner cartridge 16 is used for a color copying machine or a color printer. The information is recorded in the form of a bar code.

The toner cartridge 16 has a spiral protruding portion (not shown) on the inner peripheral surface. As a result of the formation of the protruding portion, a spiral groove 16*a* appears on the surface thereof. As described above, the toner cartridge 16 is driven by a rotating unit 19 to rotate clockwise A (a second rotational direction) to move the inside toner toward the tip portion (the inside portion viewed from the front of the machine body) to discharge the toner via a toner supply hole 17, which is provided at the tip portion, to supply the toner into the developing device 11.

Figure 3A:
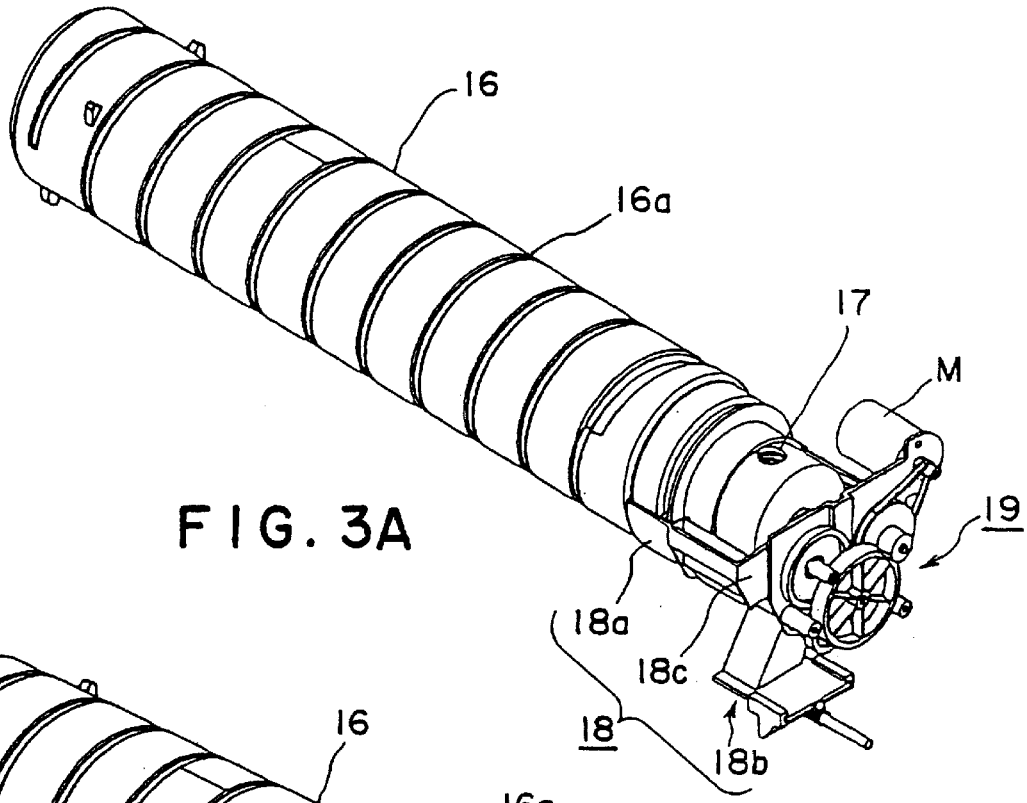
FIGS. 3A and 3B are schematic views showing the construction of a principal part of a toner supply device of the copying machine of FIG. 1.
Figure 3B:
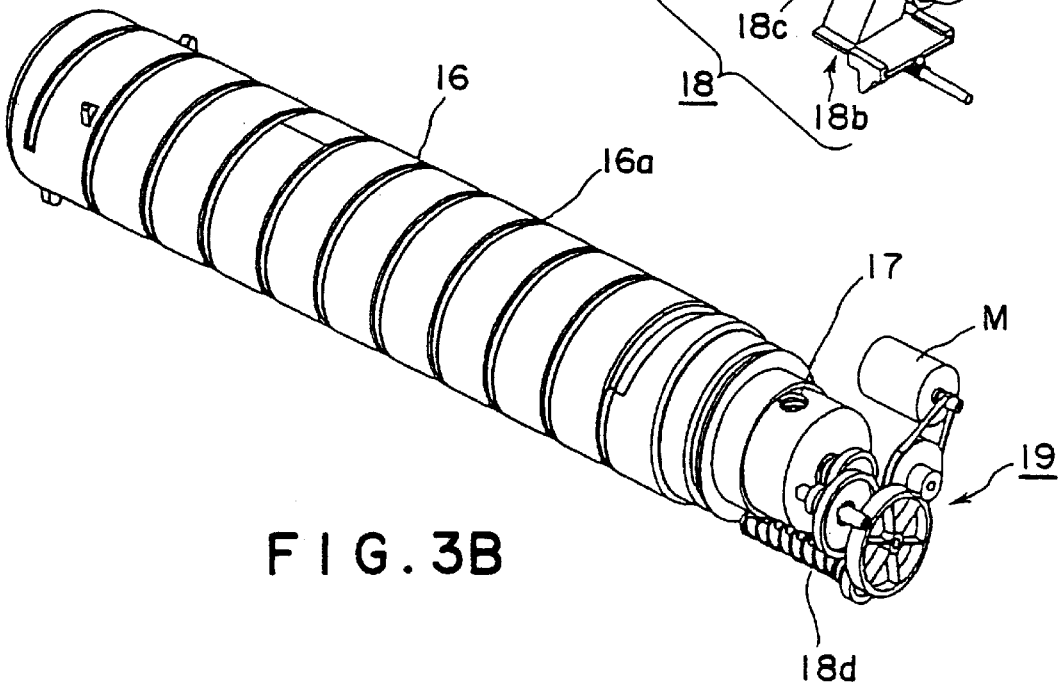

Referring to FIGS. 3A and 3B, the detailed construction of the toner supply device 7 will be described below.

FIG. 3A is a schematic perspective view of the toner supply device 7, and shows the state that the toner cartridge 16 is inserted along a guide (not shown) to be loaded in the toner supply device 7.

The toner cartridge 16 has a substantially cylindrical shape, and the toner supply hole 17 is formed in the peripheral surface of the tip portion of the toner cartridge 16. When the cartridge is attached, the tip portion thereof is pressed into the holder 18*a* of the toner supply part 18 to be connected to a rotating unit 19 which is mounted on the supporting plate 18*c* and which includes a drive motor M, a belt drive mechanism for reduction, and a gear drive mechanism. The toner supply part 18 also has a guiding 15 portion 18*b* for guiding the supplied toner to the developing device 11.

FIG. 3B more clearly shows the drive mechanism by removing the holder 18*a*, the guiding portion 18*b* and the supporting plate 18*c* from FIG. 3A. There is shown a carrier auger 18*d* for temporarily holding the toner, which is discharged from the supply hole 17, to guide the toner to the guiding portion 18*b*.

The operation of the toner supply device will be described below.

The rotating unit 19 receives a command from a control part (not shown), to rotate the toner cartridge 16 counterclockwise B (a first rotational direction) or clockwise A. By this rotation operation, the toner housed in the toner cartridge 16 is agitated. At this time, by the clockwise rotation and by the spiral shape in the toner cartridge, the toner moves toward the toner supply hole 17 at the tip portion while being agitated.

The toner discharged from the toner supply hole 17 is temporarily stored in the carrier auger 18*d* of the toner supply part 18. The toner carried by driving the carrier auger 18*d* is supplied from the guiding portion 18*b* to the developing device 11.

Figure 4:
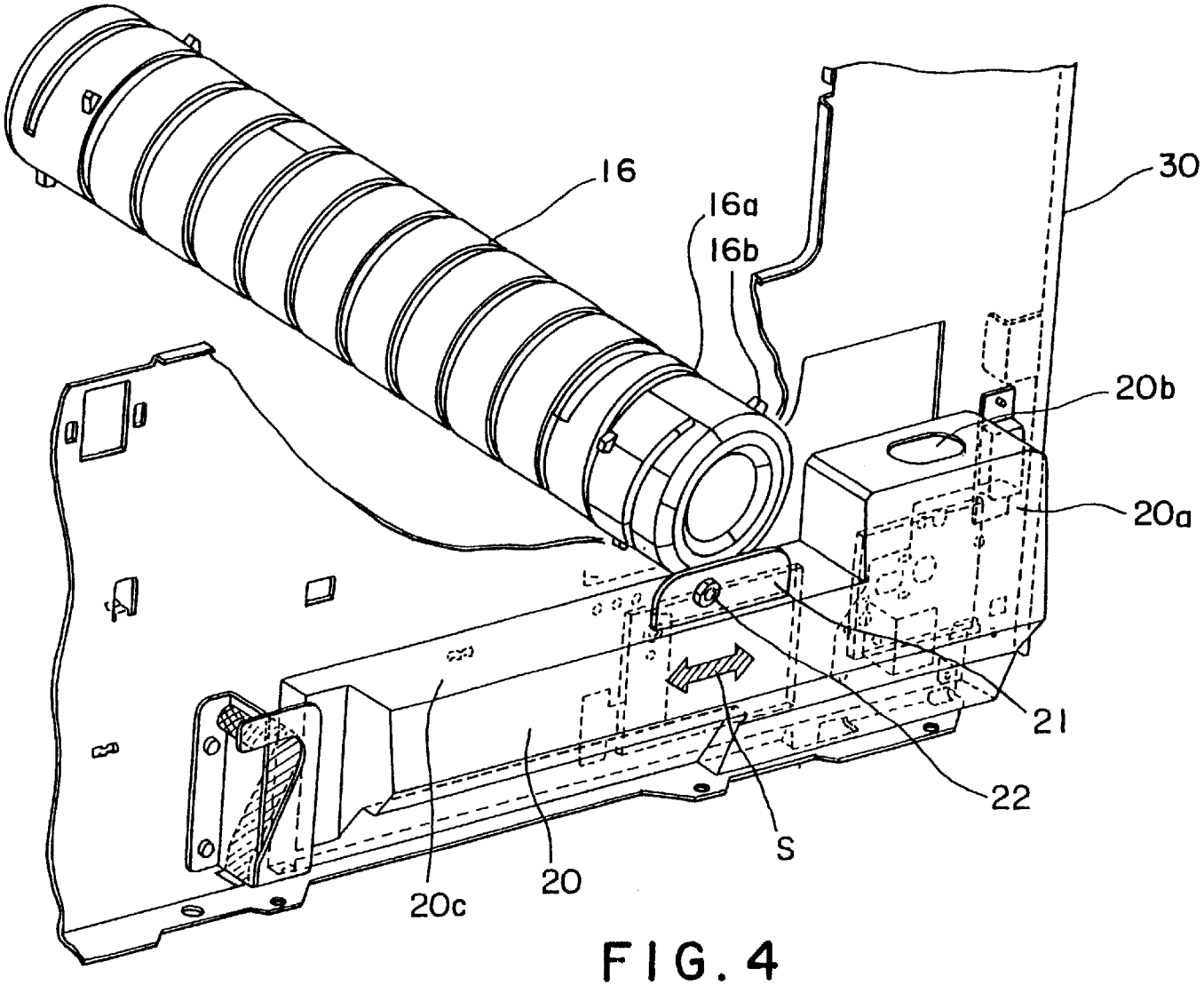
FIG. 4 is a schematic perspective view showing the construction of a part related to a toner recovery operation serving as a principal part of the present invention.

FIG. 4 is a partially broken-out perspective view showing the preferred embodiment of the present invention, which can be forced to change the accumulated state of the waste toner in the waste toner box 20.

A frame 30 for supporting the opposite end portion to the tip portion of the toner cartridge 16 on a through opening formed therein is provided on the front side of the copying machine body. The waste toner box 20 is mounted below the end portion of the toner cartridge 16 which passes through the frame 30 to protrude.

The waste toner box 20 has a laterally elongated flat box shape. Only a right end portion 20*a* of the waste toner box 20 rises so as to approach the above-described cleaner 12. An opening 20*b* is formed in the top of the right end portion 20*a*. The toner raked down by the blade of the cleaner 12 shown in FIG. 2 is introduced into the opening 20*b* by means of a suitable guiding portion to be housed in the waste toner box 20.

On the top surface 20*c* of the waste toner box 20 at a position corresponding to the toner cartridge 16, a blocking plate member 21 is provided so as to be positioned on the front side of the tip portion of the toner cartridge 16. Since the blocking plate member restricts the movement of the toner cartridge 16 toward the front side while the waste toner box 20 is attached, it is impossible to detach or exchange only the toner cartridge 16 without detaching the waste toner box 20.

In this preferred embodiment, the waste toner box 20 is slidable by a stroke S along the frame 30 in lateral directions. A protruding member 22 is provided on the reverse side (the inside) of the blocking plate member 21 on the top surface 20*c* of the waste toner box at the position corresponding to the toner cartridge 16. The position of this protruding member in longitudinal directions is the same as that of the protruding portion 16*b* provided on the end portion of the toner cartridge 16.

Figure 5:
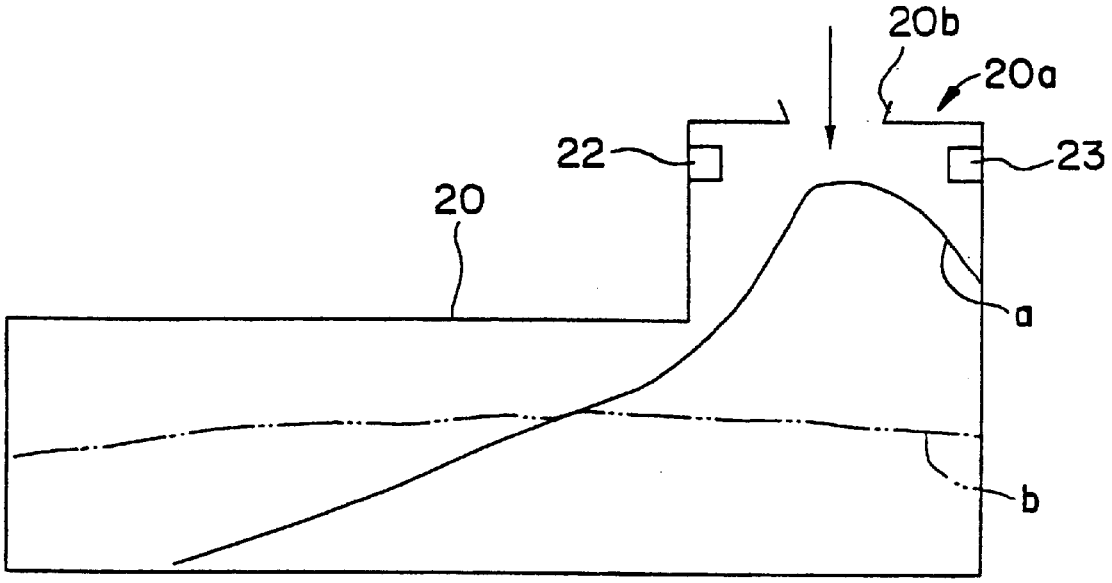
FIG. 5 is an illustration showing the state that a waste toner accumulates in a waste toner box.

Therefore, when the toner cartridge 16 is set at a predetermined position and when the waste toner box 20 is attached at a predetermined position, the toner cartridge 16 rotates to cause the protruding portion 16*b* of the toner cartridge 16 to engage the protruding portion 22 provided on the waste toner box 20 to move the waste toner box 20 to the right in FIG. 4. When the toner cartridge 16 further rotates, the protruding portion 16*b* of the toner cartridge 16 is disengaged from the protruding portion 22 of the waste toner box 20, and the waste toner box 20 is pushed to the original position by an elastic member, such as a plate spring 23, which is provided on the left end portion of the waste toner box 20. By such an oscillation operation, the accumulated state of the toner in the waste toner box is broken to be flatten, so that the accumulated state of the toner is shown by the curved line b in FIG. 5.

By such an operation, it is possible to prevent the waste toner box 20 from being clogged with the waste toner, or the waste toner from overflowing to fly.

The capacity of the waste toner box is preferably half of the capacity of the toner cartridge. If it is such a capacity, it is possible to carry out an efficient operation by exchanging the waste toner box simultaneously with the exchange of the toner cartridge when the toner cartridge is empty.

By such a simultaneous exchange, the waste toner box is exchanged before it is full of the waste toner. Therefore, it is not required to detect the amount of the waste toner in the waste toner box, so that it is possible to reduce costs.

In addition, the waste toner box can be oscillated by rotating the toner cartridge in the opposite direction to the direction of rotation for usual supply. Thus, it is possible to break the accumulation of the waste toner in the waste toner box without carrying out the toner supply operation.

Figure 6:
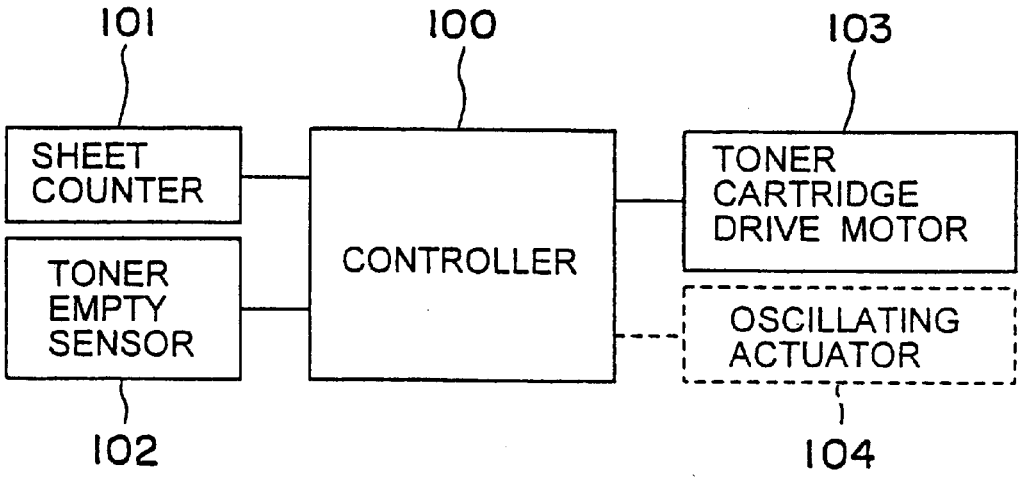
FIG. 6 is a block diagram showing a control system for oscillating a waste toner box.

FIG. 6 is a block diagram showing the construction for controlling the above described oscillation operation.

A counter 101 for counting the number of sheets, for forming an image as an input for determining the need for oscillation, and a toner empty sensor 102 in the developing part are connected to a controller 100 comprising a microcomputer or the like. A control signal from the control part is outputted to a drive motor 103 for rotating the toner cartridge, and to an actuator 104, provided if necessary, for oscillating the waste toner box.

Figure 7:
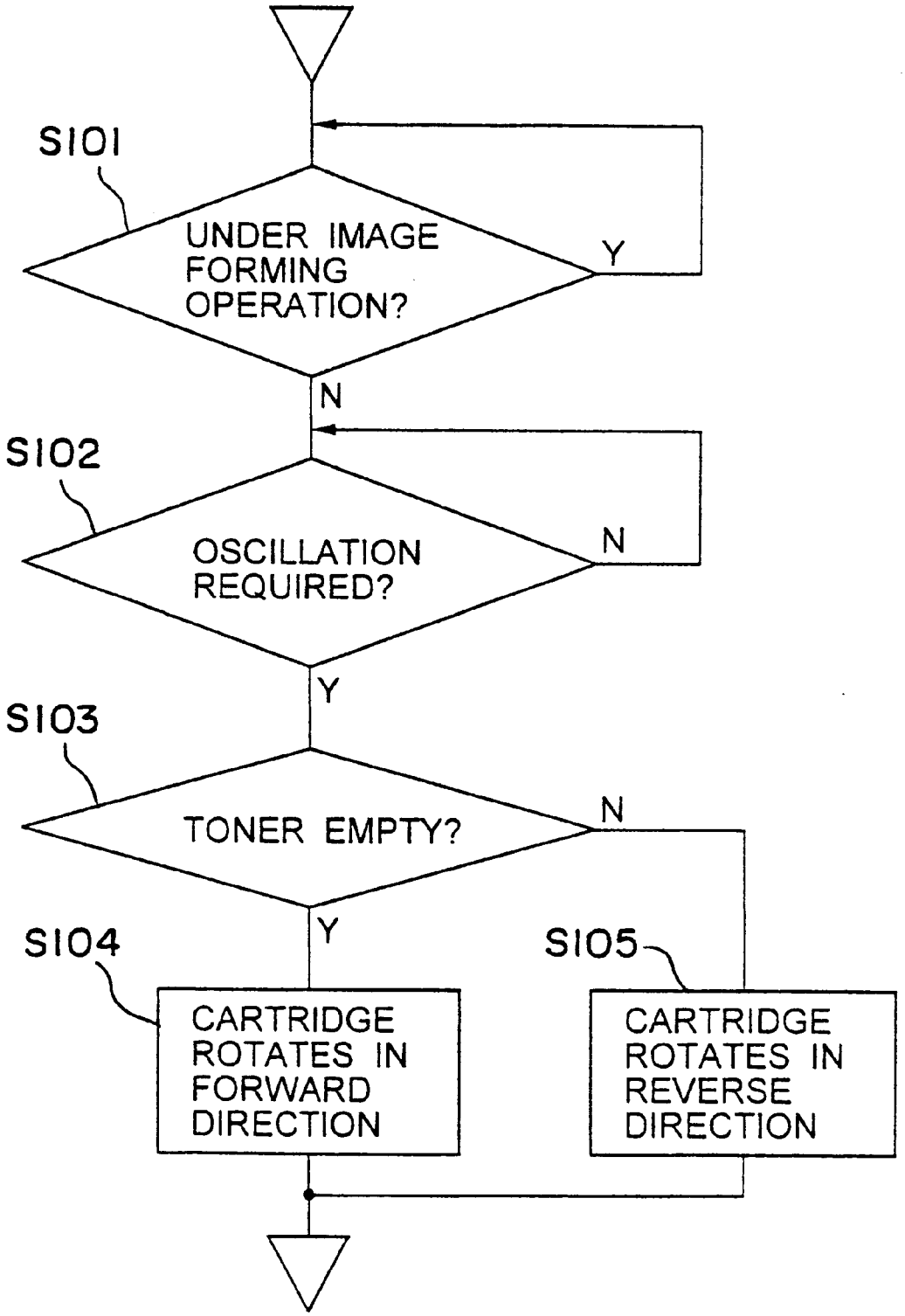
FIG. 7 is a flow chart showing the control of the oscillation of a waste toner box.

FIG. 7 is a flow chart showing the control for the oscillation of the waste toner box. This flow chart shows the control in the above described preferred embodiment, which oscillates the waste toner by the rotation of the toner cartridge.

Since the oscillation of the waste toner box causes the vibration of the image forming part, the oscillation of the waste toner box should be avoided during the formation of an image in order to maintain the quality of the image. Therefore, it is first checked whether an image forming operation is being carried out. When the image forming operation is being carried out, the processing for oscillation is stopped until the image forming operation is stopped (step S101). When a command for an image forming operation is given, an interruption processing gives the image forming processing priority although this is not disclosed in the following flow.

Then, it is determined whether oscillation is required (step S102). Since oscillation is required when the waste toner accumulates, oscillation is carried out when the number of sheets counted by the counter for counting the number of sheets reaches a predetermined number.

Then, it is checked whether it is required to supply the toner in the developing part, i.e., whether the flag of the toner empty is on (step S103). Since it is required to supply the toner when the toner empty is checked, the toner cartridge is rotated in the forward direction to carry out the supply of the toner and the oscillation of the waste toner box (step S104). On the other hand, when it is not required to supply the toner, the toner cartridge is rotated in the reverse direction to carry out only the oscillation of the waste toner box without supplying the toner (step S105).

While the oscillation of the waste toner box has been carried out by the rotation of the toner cartridge in the above-described preferred embodiment, unnecessary oscillation of the waste toner is carried out when the frequency of the supply of the toner is high.

In order to avoid this, a mechanism for oscillating the waste toner box may be provided to be controlled with the operation of the toner cartridge.

Figure 8A:
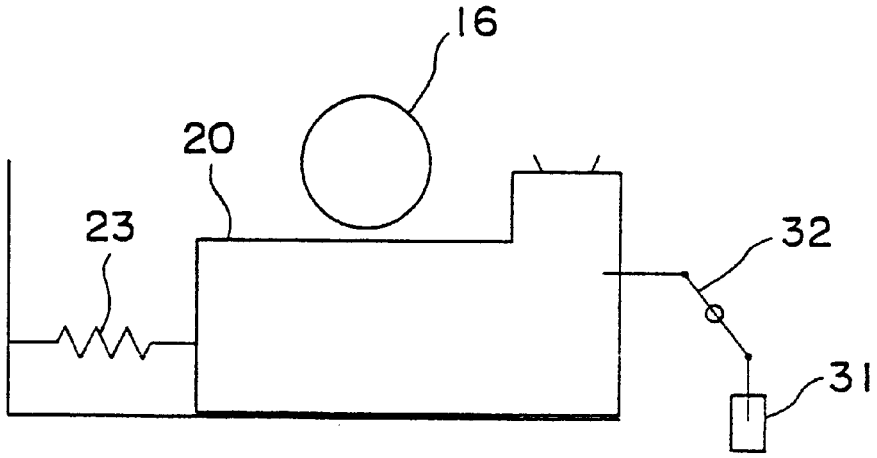
FIGS. 8A–8C are illustrations showing various embodiments for oscillating a waste toner box.
Figure 8B:
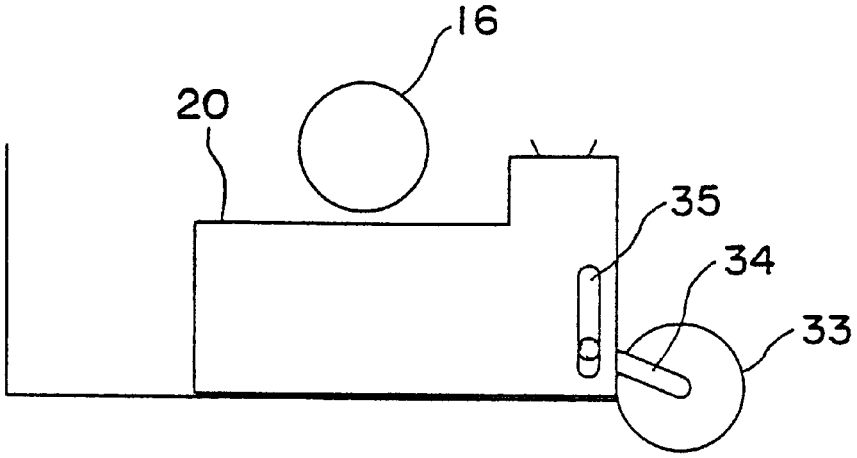
Figure 8C:
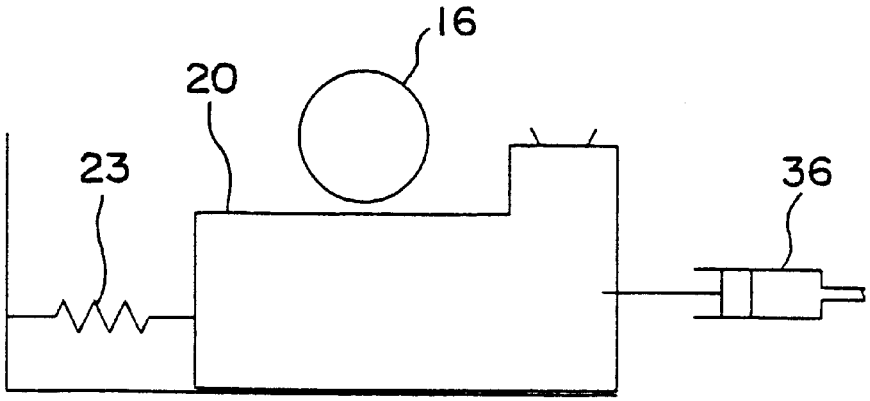

FIGS. 8A through 8C are schematic diagrams showing the construction for oscillating the waste toner box 20.

FIG. 8A shows an example where a combination of an electromagnetic solenoid 31 with a lever 32 is adopted, FIG. 8B shows an example where a combination of a rotary solenoid 33, an arm 34 and an elongated hole 35 is adopted, and FIG. 8C shows an example where the waste toner box is driven by a pump 36 using a fluid, such as air. It is required to provide a biasing member, such as a spring, for returning the waste toner to an initial position, except for the example where the rotary solenoid is adopted.

With the above-described constructions, the operation from exchange of the toner cartridge to the supply of the toner will be described in detail below.

First, the user opens a front cover which is provided on the front surface of the image forming part 80 and which is capable of being open and closed, detaches the waste toner box 20 mounted on the front surface, and extracts the empty toner cartridge 16. Then, the user attaches a new toner cartridge 16, which has been prepared, on the toner supply device 7, attaches a waste toner box, which is a companion to the toner cartridge, at a predetermined position, and closes the front cover.

When the new toner cartridge 16 is attached, the copying machine 1 determines whether the attached toner cartridge 16 is a certified product before a toner supply operation is carried out.

Specifically, the toner cartridge 16 is rotated by the rotating unit 19 of the toner supply part 18 counterclockwise B, i.e., in the opposite direction to the rotational direction A during supply, by two revolutions or more. Thus, the optical sensor 40 reads information recorded on the discriminating label. At this time, if the discriminating label is not applied on the toner cartridge 16 or if information different from a desired specification is recorded on the applied discriminating label, the copying machine 1 determines that the attached toner cartridge 16 is a non-certified product, so that the copying machine 1 is stopped.

The determined result indicative of the non-certified product may be displayed on a control panel so as to be given to the user, or may be derived only by a field engineer by inputting a predetermined service code. In addition, if the operating condition of the copying machine can be remote-controlled using a communication line or the like, information relating to the determined result may be transmitted to a control computer of a service center to be communicated to a field engineer, an agent in charge of the user, or a salesman.

Furthermore, when the non-certified toner cartridge 16 is attached, the blocking plate member 21 of the waste toner box 20 interferes with the front surface of the toner cartridge 16 to prevent the toner cartridge 16 from being attached, or the waste toner box can not oscillate since the toner cartridge does not have any protruding portions which are engageable with the protruding portion of the waste toner box 20. Thus, the non-normal toner cartridge 16 can be found.

The cleaning part 301 cleans the surface of the discriminating label to remove dust, such as toner and paper powder, which adheres thereto, before the reading operation of the optical sensor 40.

When the optical sensor 40 reads the fact that the information recorded on the discriminating label is coincident with the condition of the specification, the copying machine 1 determines that the attached toner cartridge 16 is a certified product, and ends the above described discriminating operation.

Then, the toner supply device 7 carries out an operation 25 of agitating the toner in the toner cartridge 16 before the toner is supplied to the developing device 11. That is, the rotating unit 19 rotates the toner cartridge 16 about a position, at which the discriminating label is applied, alternately clockwise A and counterclockwise B by predetermined angles, respectively.

Since such an oscillating operation can break lumps of the toner if the toner has gathered in the toner cartridge 16 in a preservation period and/or in a state of preservation, the amount of the toner subsequently supplied can be stabilized. Thus, it is not required to carry out the agitating operation for the toner cartridge 16, which has been conventionally carried out by the user before attaching the toner cartridge 16, so that it is possible to relieve the user's work load.

Thereafter, the above described toner supply operation is carried out.

While the preferred embodiments of the present invention have been described above, the present invention should not be limited thereto, but the invention can be embodied in various ways without departing from the principle of the invention.

For example, the oscillating mechanism should not be limited to the above described mechanism, and may be a mechanism for making vibrations and/or impacts to such an extent that the internal waste toner can be broken at a desired point.

In addition, at least one of the protruding portions of the waste toner box and toner cartridge can be formed to protrude when necessary. In this case, it is possible to avoid the oscillation of the waste toner box when the toner is supplied.

What is claimed is:

1. An image forming system comprising:

a developing device for causing a toner to adhere to a latent image, which is formed on a photosensitive material drum, to form a visible image;

a toner supply device for supplying a toner, which is housed in a toner container, to said developing device;

a toner removing device for removing a remaining toner after said visible image on said photosensitive material drum is transferred to a transfer paper;

a waste toner container for accumulating therein a waste toner removed by said toner removing device; and an oscillating mechanism for oscillating said waste toner container;

wherein said oscillating mechanism comprises:

a rail member for allowing said waste toner container to slide;

a first protruding portion provided on the top surface of said waste toner container at a position, at which said first protruding portion faces said toner container;

a second protruding portion provided on said toner container at a position, at which said second protruding portion faces said first protruding portion; and a biasing member for returning said waste toner container, which has been oscillated by the engagement of said first protruding portion with said second protruding portion by the rotation of said toner container, to an initial position.

2. An image forming system as set forth in claim 1, which further comprises an oscillation control unit for causing the toner to be supplied by a forward rotation of said toner container when the toner is insufficient, except for when an image is formed, and for sliding said waste toner container.

3. An image forming system as set forth in claim 1, which further comprises an oscillation control unit for sliding said waste toner container without supplying the toner by a reverse rotation of said toner container when the toner is insufficient and when oscillation is required, except for when an image is formed.

4. An image forming system as set forth in claim 3, wherein the need for oscillation is determined by whether a value counted by a counter for counting the number of sheets, on which images have been formed, reaches a predetermined value.

5. An image forming system comprising:

a developing device for causing a toner to adhere to a latent image, which is formed on a photosensitive material drum, to form a visible image;

a toner supply device for supplying a toner, which is housed in a toner container, to said developing device;

a toner removing device for removing a remaining toner after said visible image on said photosensitive material drum is transferred to a transfer paper;

a waste toner container for accumulating therein a waste toner removed by said toner removing device; and an oscillating mechanism for oscillating said waste toner container;

wherein said waste toner container has an interfering member for inhibiting said toner container from being attached and detached when said waste toner container is attached at a predetermined position.

6. An image forming system as set forth in claim 5, wherein said interfering member is positioned on a line extending from the axis of said toner container, and said interfering member is a member for inhibiting the movement of said toner container in a detached direction after said toner container is attached at a predetermined position.

7. A waste toner container for use in an image forming system comprising: a developing device for causing a toner to adhere to a latent image, which is formed on a photosensitive material drum, to form a visible image; a toner supply device for supplying a toner, which is housed in a toner container, to said developing device; and a toner removing device for removing a remaining toner after said visible image on said photosensitive material drum is transferred to a transfer paper, said waste toner container accumulating therein a waste toner removed by said toner removing device, and said waste toner container having an oscillating mechanism for oscillating said waste toner container to break the accumulation of a waste toner therein, wherein said oscillating mechanism comprises:

a rail member for allowing said waste toner container to slide;

a protruding portion provided on the top surface of said waste toner container at a position, at which said protruding portion faces a protruding portion formed on the peripheral surface of an end portion of said toner container; and a biasing member for returning said waste toner container, which has been oscillated by the engagement of said protruding portion of said toner container with said protruding portion of said waste toner container by the rotation of said toner container, to an initial position.

8. A waste toner container for use in an image forming system comprising: a developing device for causing a toner to adhere to a latent image, which is formed on a photosensitive material drum, to form a visible image; a toner supply device for supplying a toner, which is housed in a toner container, to said developing device; and a toner removing device for removing a remaining toner after said visible image on said photosensitive material drum is transferred to a transfer paper, said waste toner container accumulating therein a waste toner removed by said toner removing device, and said waste toner container having an oscillating mechanism for oscillating said waste toner container to break the accumulation of a waste toner therein, which further comprises an interfering member for inhibiting said toner container from being attached and detached when said waste toner container is attached at a predetermined position.

9. A waste toner container as set forth in claim 8, wherein said interfering member is positioned on a line extending from the axis of said toner container, and said interfering member is a member for inhibiting the movement of said toner container in a detached direction after said toner container is attached at a predetermined position.

10. A toner container for use in an image forming system comprising: a developing device for causing a toner to adhere to a latent image, which is formed on a photosensitive material drum, to form a visible image; a toner supply device for supplying the toner to said developing device; a toner removing device for removing a remaining toner after said visible image on said photosensitive, material drum is transferred to a transfer paper; and a waste toner container for accumulating therein a waste toner removed by said toner removing device, said waste toner container being oscillatable and biased so as to return to an initial position, said toner container housing therein the toner supplied to said toner supply device, said toner container having a protruding portion which is engageable with a protruding portion provided on said waste toner container when said toner container is attached at a predetermined position, and said toner container rotating to slide said waste toner container.

11. A toner container as set forth in claim 10, which causes the toner to be supplied by a forward rotation of said toner container when the toner is insufficient, except for when an image is formed, and for sliding said waste toner container.

12. A toner container as set forth in claim 10, which slides said waste toner container without supplying the toner by a reverse rotation of said toner container when the toner is insufficient and when oscillation is required, except for when an image is formed.

* * * * *